US005542334A

United States Patent [19]

Wells

[11] Patent Number: 5,542,334

[45] Date of Patent: Aug. 6, 1996

[54] MISSILE LAUNCH SAFETY ENHANCEMENT APPARATUS

[75] Inventor: Michael L. Wells, Newhall, Calif.

[73] Assignee: Hughes Aircraft Company, Los Angeles, Calif.

[21] Appl. No.: 339,861

[22] Filed: Nov. 15, 1994

[51] Int. Cl.[6] ..... F42C 15/40

[52] U.S. Cl. ..... 89/1.812; 244/3.12

[58] Field of Search ..... 89/1.812; 244/3.12

[56] References Cited

U.S. PATENT DOCUMENTS

| | | | |
|---|---|---|---|
| 3,983,785 | 10/1976 | Dissmeyer et al. | 89/1.812 |
| 4,372,212 | 2/1983 | Hoelzen et al. | 89/1.812 |
| 5,031,537 | 7/1991 | Taylor | 89/1.812 |

*Primary Examiner*—Charles T. Jordan
*Assistant Examiner*—Theresa M. Wesson
*Attorney, Agent, or Firm*—Georgann S. Grunebach; Wanda K. Denson-Low

[57] ABSTRACT

A missile launch safety enhancement apparatus (135) for inhibiting the launch sequence of a missile launched from an aircraft-based or land vehicle-based missile launch system. The apparatus (135) incorporates means for producing a prefire signal (102*a*). The prefire signal produced is then compared to a reference signal level by comparing means (167). If the prefire signal is not below the reference signal level by a predetermined amount, interrupting means (216, 240) inhibits the firing sequence of the missile and thus prevents the missile from being launched. If the prefire signal is below the reference signal level by a predetermined amount indicating proper current drawn by the circuit, the firing sequence is not inhibited, and the missile is launched.

16 Claims, 4 Drawing Sheets

MISSILE LAUNCH SAFETY ENHANCEMENT APPARATUS

BACKGROUND OF THE INVENTION

1. Technical Field

This invention relates generally to a missile launch system, and, more particularly, to a safety enhancement for a missile launch system for insuring that a missile warhead is properly initialized before a missile is launched.

2. Discussion

In conventional aircraft-based missile guidance and tracking systems, three command sequences occur before and immediately after a missile actually leaves a missile launcher mechanism. First, upon a system operator activating a fire command, the system generates prefire signals to enable the missile control electronics. A missile is fired from the aircraft only subsequent to this prefire signal being generated. Second, the system generates signals causing the missile to fire. Third, after the missile impacts the target, the system generates signals that cut the wires connecting the missile to the launcher, thus allowing a new missile to be selected and eliminating the danger of the wires becoming entangled in aircraft engines, helicopter rotors or other equipment.

One critical drawback to conventional aircraft missile launch systems is that a missile may be fired even if the missile control electronics is not properly enabled. The missile may be fired with nonenabled electronics due to any of several mechanical reasons. First, prefire signals may never reach the missile due to faulty wiring in the aircraft itself. Second, prefire signals may not reach the missile due to faulty or dirty launcher-to-missile connections. The latter reason is a result of launcher-to-missile umbilical connections, external to both the aircraft and the missile, and thus being highly susceptible to damage from dirt or other adverse conditions caused by the surrounding environment.

As a result, a missile may be launched without ever receiving the prefire signal, or after receiving a prefire signal too weak to actually enable the electronics. A missile thus launched will never reach its target, but instead will fall harmlessly to the ground without exploding. As a result, enemy troops or other hostile parties may recover a fully functional warhead.

What is needed then is a safety enhancement for a missile launch mechanism that ensures that a fired missile is properly initialized so that the missile electronics and ultimately the warhead is enabled.

SUMMARY OF THE INVENTION

In accordance with the teachings of the present invention, a missile launch safety enhancement apparatus is provided for inhibiting the firing sequence of a missile if the missile prefire sequence does not properly enable the warhead of the missile. The apparatus finds utility in both aircraft-based and land vehicle-based missile launching systems. The apparatus includes means for producing a prefire signal and means for comparing the prefire signal to a reference signal level. If the prefire signal is not above the reference signal level by a predetermined amount, the apparatus includes a means for interrupting the missile firing sequence, thereby preventing a missile having a nonenabled warhead from being fired and falling into enemy hands.

BRIEF DESCRIPTION OF THE DRAWINGS

The various advantages of the present invention will become apparent to those skilled in the art after studying the following disclosure and by reference to the drawings in which.

DETAILED DESCRIPTION

The following description of the preferred embodiments is merely exemplary in nature and is in no way intended to limit the invention or its application or uses.

Figure 1:
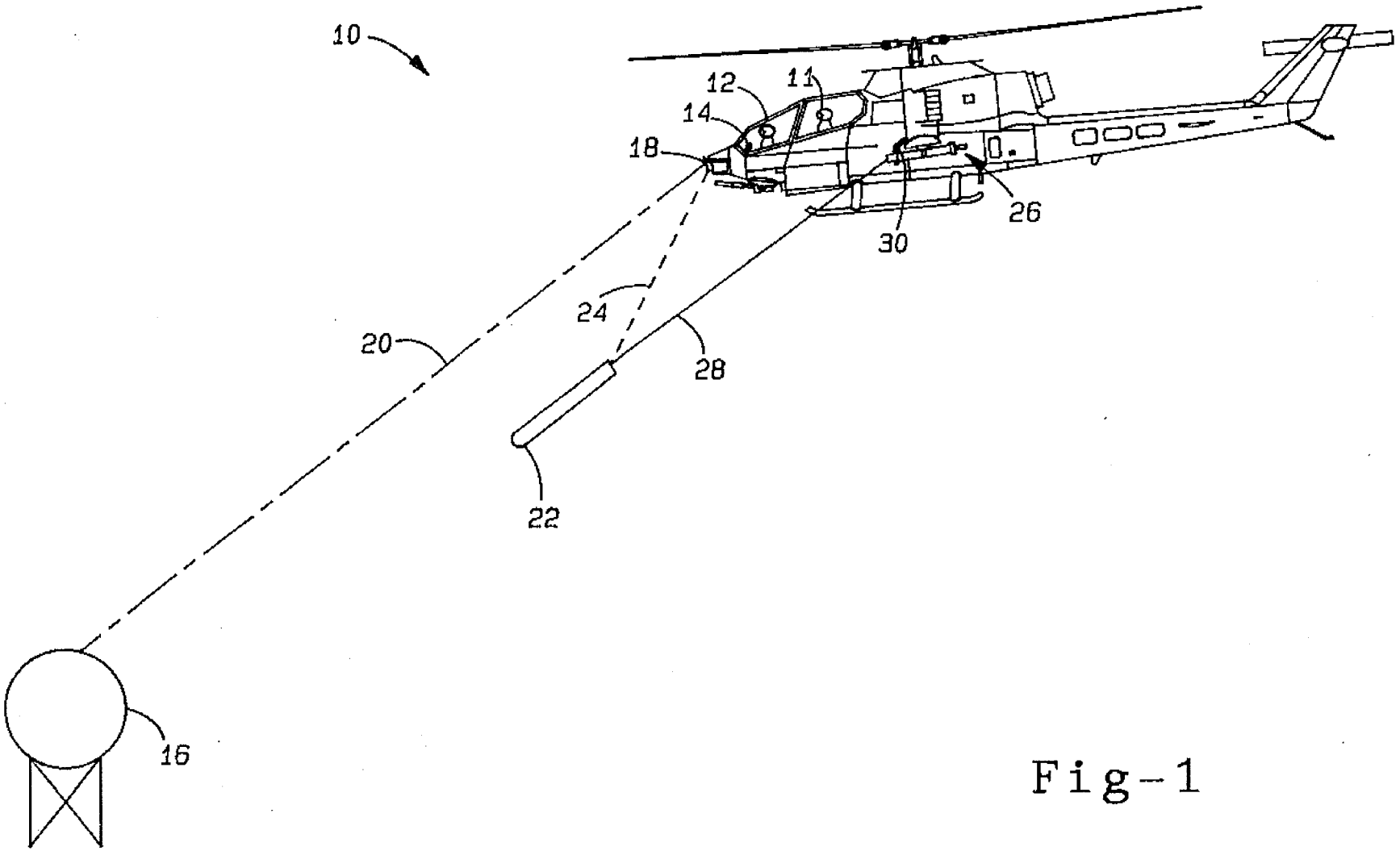
FIG. 1 is a side elevational view of a helicopter in which the present invention is implemented.

Referring to the drawings, FIG. 1 illustrates a side view of a helicopter, shown generally at 10, in which the present invention is implemented. Preferably, this is a AH-1 series Cobra attack helicopter. However, it is contemplated that the invention may also be implemented in a 500 MD series attack helicopter, or in other types of aircraft employing guided missile systems. As is shown, as pilot 11 flies the helicopter, system operator, or gunner, 12 uses eyepiece 14, to locate missile target 16. System operator 12 uses eyepiece 14 to view an image of target 16 as detected by optics 18. Optics 18 are preferably of the type shown and described in detail in U.S. Pat. No. 3,989,947 to Chapman entitled "Telescope Cluster," which is assigned to Hughes Aircraft Company, the assignee of this invention, and which is hereby incorporated by reference. As disclosed in Chapman, optics 18 detect the target, as represented by line 20.

In addition, optics 18 detect missile 22 via tracking signal 24 emitted by missile 22 after the missile is fired from missile firing mechanism 26. Typically, this tracking signal is the infrared radiation emitted from a source in the missile. Tracking signal 24 is processed by the missile guidance and tracking system as will be described in more detail below. The system uses the processed tracking signal to compute missile guidance signal 28, which is transmitted to the missile to keep the missile from deviating from its intended course. The missile guidance signal may be communicated to missile 22 via either a wire or wireless connection, dependant upon the type of system implemented, and is transmitted from the guidance and tracking system within aircraft 10 through external umbilical connection 30 and missile launcher 32 to missile 22 or an antenna.

Missile 22 is preferably a TOW missile implemented in one of the TOW missile systems well known to those skilled in the art. The present invention is preferably implemented in one of these TOW missile systems, such as the M-65 system that is shown for exemplary purposes in block diagram form in FIG. 2. While the block diagram in FIG. 2 illustrates an M-65 TOW missile system, it should be appreciated by those skilled in the art, upon reading the detailed description below, that the present invention may also be implemented in other TOW missile systems, such as the M-65, M-65/LAAT, M-65 C-NITE and TAMAM Night Targeting System (NTS or NTS-A) Systems and other aircraft-based missile and guidance tracking systems incorporating many of the same, or similar, components of the above-described M-65 TOW missile system.

The M-65 system, shown generally at 36, includes stabilization control amplifier (SCA) 38, telescopic sight unit (TSU) 40, having an error detector computer 42, and missile command amplifier (MCA) 44. SCA 38 sends pilot steering commands, indicated at 46, to head up display 47 to indicate to the pilot the position of the sighting optics with respect to the aircraft. SCA 38 receives, from pilot/gunner helmet sight 48, acquisition commands 50, representing target location when acquired using the helmet sight, and gunner commands 54 from sight hand control 52 for tracking target 16. In addition, SCA 38 also receives commands 56 from TOW control panel 58. These TOW control panel commands 56 result from pilot master arm commands 57, and system mode commands from gunner 12.

SCA 38 also receives data 60 concerning aircraft air speed from air speed sensor 62 and data 64 representing aircraft pitch angle and aircraft roll angle from aircraft vertical gyro sensor 66. In addition, SCA receives error signals 72 processed from data received from on-gimbal elevation and azimuth gyros and accelerometers and returns azimuth and elevation stabilization commands 72 to stabilize gimbal mounted telescope cluster (not shown) of TSU 40 and as disclosed in Chapman.

Figure 2:
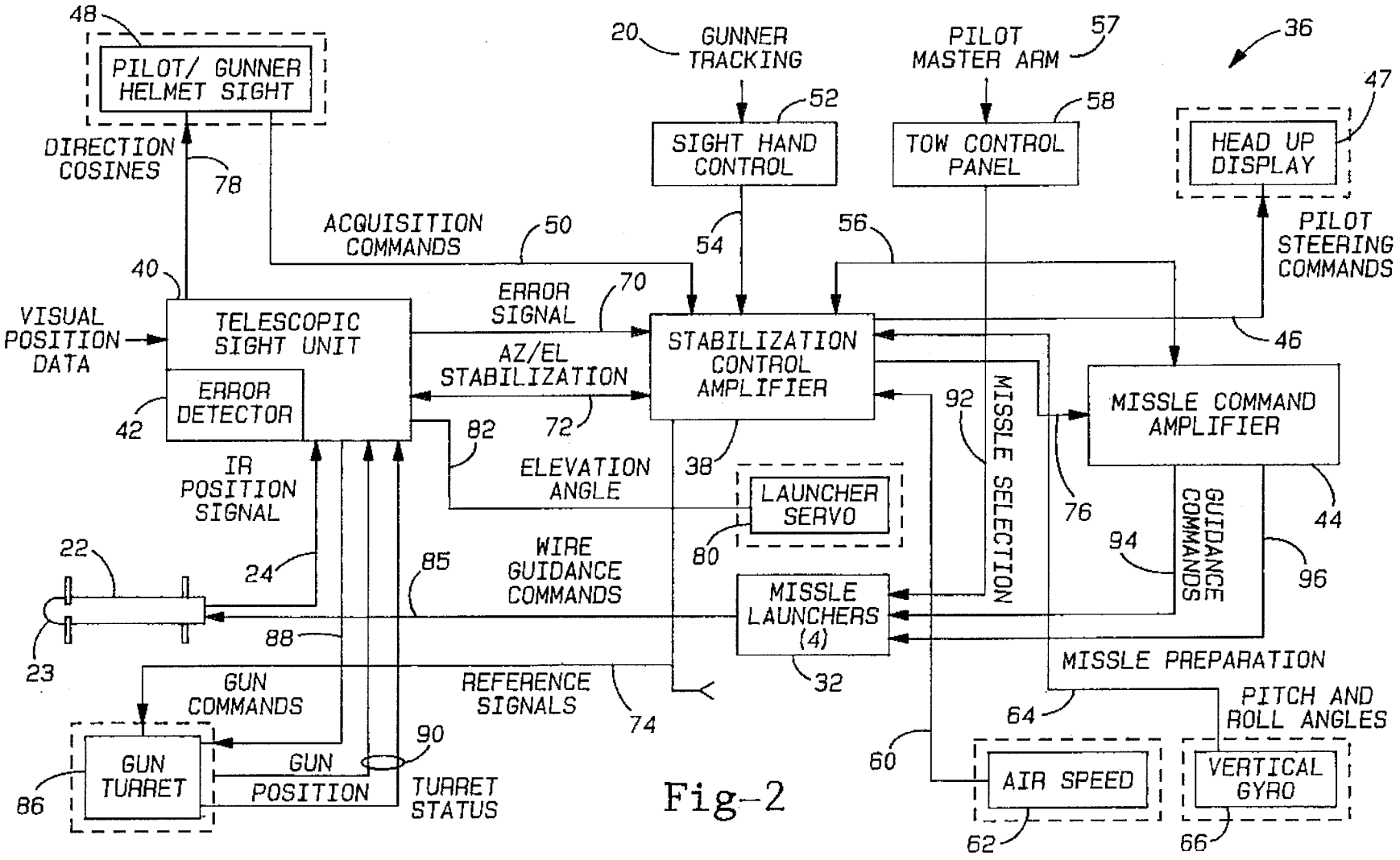
FIG. 2 is a simplified block diagram showing an exemplary missile system in which the present invention may be implemented.

Still referring to FIG. 2, TSU 40, in addition to being connected to SCA 38, is also connected to pilot/gunner helmet sight 48 for providing the sight with direction cosines 78 for target acquisition purposes. TSU 40 is also connected to launcher servo 80 to provide aircraft elevation angle data 82 to the servo to allow missile launcher 32 to be correctly positioned before firing missile 22. TSU 40 is also connected to gun turret 86 to provide gun position commands 88 and to receive gun position data 90 from turret 86.

Again referring to FIG. 2, in addition to receiving steering data from SCA 38 for output to missile 22, MCA 44 is connected to missile launchers 32 for missile selection as determined by TOW Control Panel (TCP) 58 or other controlling device at 92 for providing guidance commands 85 to missile launchers 32 through guidance commands 94 and for providing missile preparation commands 96, such as prefire signals, to missile 22 through missile launchers 32.

Figure 3:
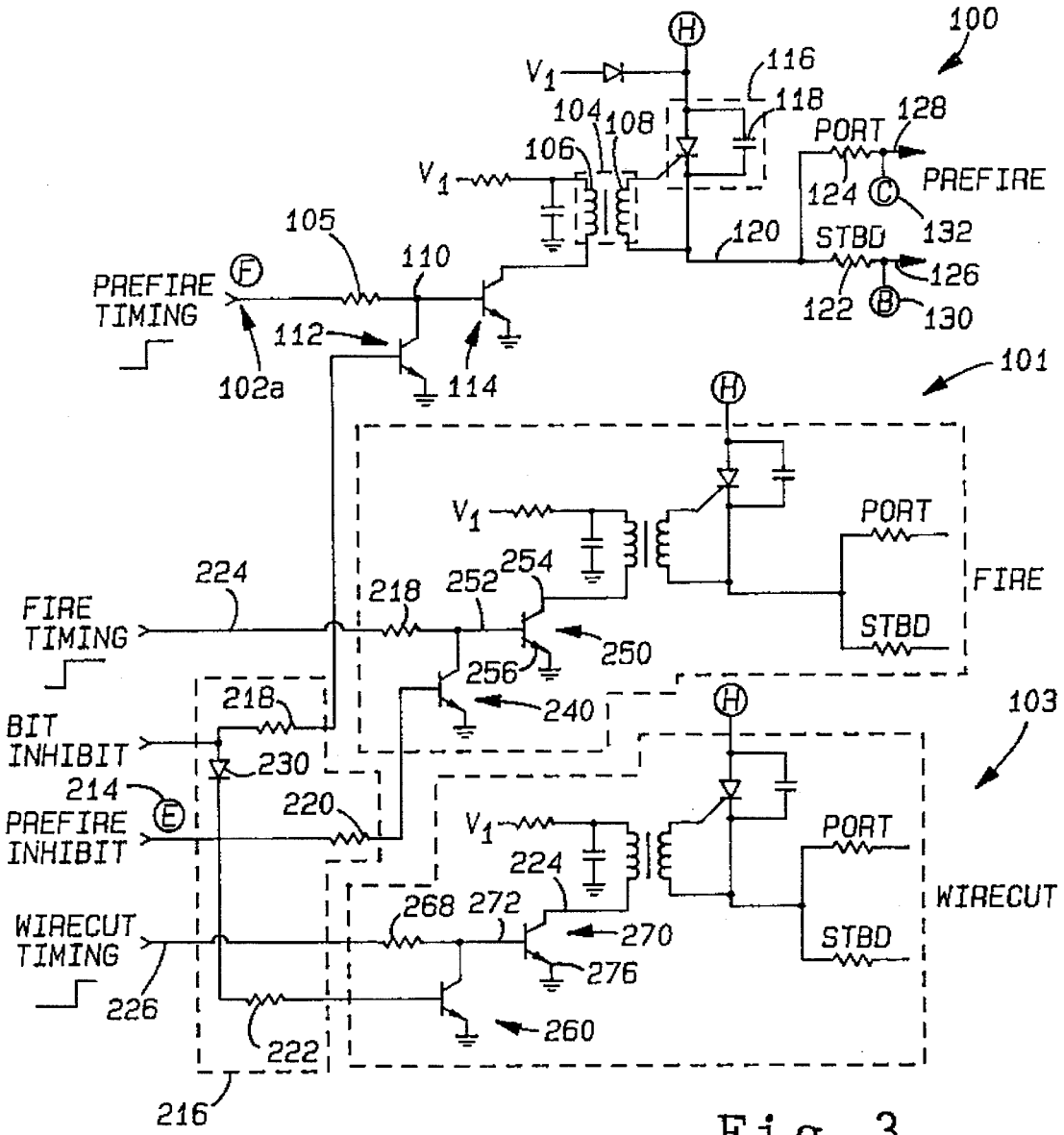
FIG. 3 is a simplified electrical schematic diagram showing an existing timing circuit to which the present invention is connected.
Figure 4:
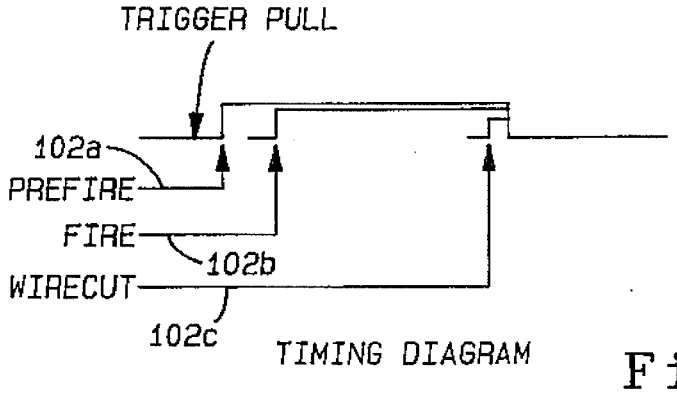
FIG. 4 is a diagram showing the timing of the prefire, fire and wire cut sequences of the missile system.

Referring to FIGS. 3 and 4, a circuit diagram of an existing prefire timing circuit is shown generally at 100. Subsequent to a system operator activating a fire command, prefire signal 102*a*, as shown in FIG. 4, is a step function generated by a timing circuit (not shown) in MCA 44, as are fire and wire cut signals 102*b* and 102*c*. Prefire signal 102*a* is input through resistor 105 and pulse transformer 104, having two sets of windings 106 and 108, to generate a signal to SCR 116. The prefire signal is also connected at 110 as will be described in more detail below.

The transferred pulse turns on a gate of silicon control rectifier (SCR) 116. Capacitor 118 prevents accidental activation of SCR 116 during turn on. The input of SCR 116 is tied to aircraft system power $V_1$ through diode 112. Preferably, the value for $V_1$ is 28 volts. Subsequently, as SCR 116 receives the pulse signal from pulse transformer 104, the gate of SCR 116 turns on and causes current to flow, as indicated at 120. The current is drawn by either current limiting resistor 122 or current limiting resistor 124, depending upon whether the prefire signal is directed to a missile on the starboard side 126 or the port side 128 of aircraft 10. Dependent upon whether the current is directed a starboard side missile or a port side missile, the current is also input to the launch safety enhancement mechanism at 130 or 132 as will be described in more detail below.

At this point, it should be understood that fire timing circuit 101 and wire cut timing circuit 103 are identical to prefire timing circuit 100 as described above. Fire and wire cut lines, and thus fire and wire cut commands, are inhibited by prefire inhibit line 214 as will be described in more detail below.

Figure 5:
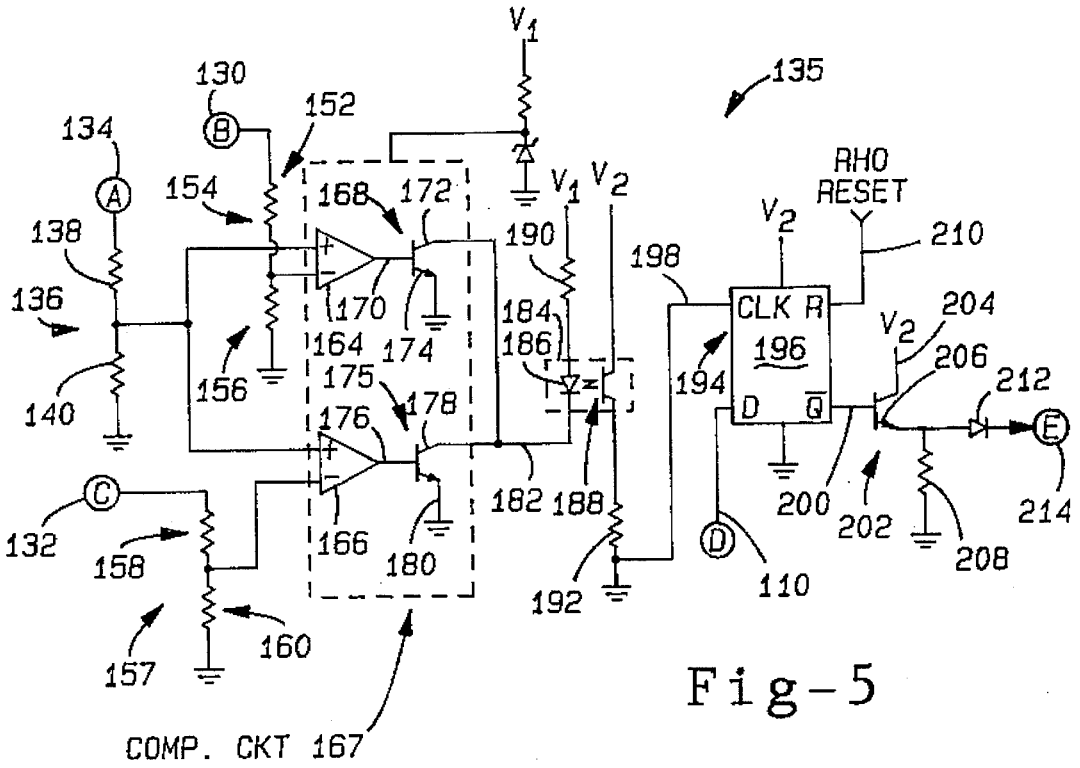
FIG. 5 is a simplified electrical schematic diagram showing the preferred embodiment of the present invention.

Turning now to FIG. 5 a block/schematic diagram of a majority of the missile launch safety enhancement apparatus is shown generally at 135. Current 120 output from SCR 116 is split and applied at 134 to voltage divider 136 consisting of resistors 138 and 140. This forms a reference voltage. The input at 130 is applied to voltage divider 152 consisting of resistors 154 and 156. The input at 132 is applied to voltage divider 157, which consists of resistors 158 and 160. Voltage divider 136 is tied to the high inputs of both comparators 164 and 166 of comparator circuit 167, while voltage divider 152 is applied to the low input of comparator 164 and voltage divider 157 is applied to the low input of comparator 166. The comparators monitor the difference between the reference voltage before the current limiting resistors 122 and 124 and after them to indicate the current drawn through prefire circuit 100.

The output of comparator 164 is tied to open collector transistor 168 consisting of base 170, collector 172 and emitter 174. Similarly, the output of comparator 166 is tied to open collector transistor 175 consisting of base 176, collector 178 and emitter 180. Collectors 172 and 178 are connected to the input of optical isolator 184, consisting of diode 186 and optical transistor 188.

Optical isolator 184 isolates the components tied to aircraft system voltage $V_1$ and the components tied to safety enhancement voltage $V_2$. Diode 186 is tied to $V_1$ by resistor 190. Optical transistor 188 is tied high to $V_2$ and to safety enhancement ground by resistor 192. Preferably, $V_2$ is set at +5 volts.

The output 198 of optical isolator 184 is tied to clock input 194 of flip flop 196. Preferably flip flop 196 is a D type flip flop, model no. 74 LS 74A or equivalent. Flip flop D line 110 is tied to the input line of the timing circuit carrying the input prefire pulse 102. The output "not Q" is tied to base 200 of transistor 202, which also consists of collector 204 tied to $V_2$ and emitter 206 tied to system ground by resistor 208. The output "not Q" normally remains high, causing prefire and wire cut sequences to remain inhibited, unless a prefire current of sufficient strength is generated, as will be described in detail below. The output of emitter 206 is tied to diode 212. The output of diode 212 is tied at 214 to the input of resistor matrix 216.

As shown in FIG. 3, resistor matrix 216 consists of resistors 218, 220 and 222, which are preferably 30 kilo ohm resistors. Resistor matrix 216 is an existing circuit used for a built in test (BIT) mode, for testing the launch system, that is modified through diode 230 being inserted between resistors 218 and 220 for fire and wire cut sequence inhibiting as set forth in more detail below. Current flowing at 214 across resistor 220 turns on transistor 240, which is used to inhibit fire transistor 250 by shorting out base 252. Emitter 256 of fire transistor 250 is connected to system return. Similarly, current flowing at 214 across resistor 222 turns on inhibit transistor 260, which is used to inhibit wire cut transistor 270 by shorting out base 272. Emitter 276 of transistor 270 is connected to system return.

Referring to FIGS. 3, 4 and 5, operation of the present invention will now be described. Prefire signal 102*a* from the timing circuit is generated. The prefire step function is received at pulse transformer 104, causing current to flow from SCR 116 to either current limiting resistor 122 or current limiting resistor 124, dependent upon the missile to be fired. The subsequent explanation of operation of the present invention will be given under the assumption that the system operator has chosen to fire a starboard side missile. However, it should be understood that operation of the preferred embodiment of the present invention is identical for a prefire signal directed to the portside missile.

Referring to FIGS. 3 and 5, current 120 flows, causing a voltage drop across current limiting resistor 122. Voltage divider 136 is set at a predetermined voltage within the dynamic range of comparators 164 and 166. As current 120 flows, the voltage drop across current limiting resistor 122 is measured by voltage divider 152.

If the current is sufficient to ignite prefire thermal battery squibs (not shown), of the type commonly used to initiate a missile prefire sequence and which are well known to those skilled in the art, to enable missile guidance circuits and subsequently the warhead 23, the voltage across voltage divider 152 is great enough to cause the difference in voltage between voltage divider 136 and voltage divider 152 to turn on comparator 164.

As comparator 164 is turned on, transistor 168 is also turned on. Subsequently, optical isolator 184 is also turned on. Optical isolator 184 in turn causes clock 194 to go high. As the D line input 110 to flip flop 196 goes high in response to the prefire signal, the resulting positive transition of clock 194 causes Q to go high and thus "not Q" output to go low. As a result, the output of transistor 202 goes low, and no current flows through diode 212 at 214 to resistor matrix 216. Thus, the fire and wire cut inhibit lines 224 and 226, are low and fire and wire cut sequences are uninhibited, as described below.

Referring to FIG. 3, as the output at 214 goes low, no current flows across fire inhibit and wire cut inhibit resistors 220 and 222 on fire and wire cut inhibit lines 224 and 226. Thus, the output from transistor 240 goes low. As the output of transistor 240 goes low, the base 252 of transistor 250 is not shorted out by the output of transistor 240. As a result, the fire pulse transformer of circuit 101 receives pulse signal 102*b*, and current flows through circuit 101 to initiate the fire sequence. The wire cut sequence works in a like manner.

Alternatively, if current 120 is below a predetermined amount needed to ignite the thermal battery squibs and thus properly enable the starboard side missile warhead, voltage across voltage divider 152 does not drop to a level sufficient enough to cause the differential voltage across comparator 164, and comparator 164 does not turn on. Subsequently, no current flows from collector 172, and optical isolator 184 does not turn on. Because optical isolator 184 does not turn on, clock 194 does not clock high and the output "not Q" remains high. This causes the output current to flow through transistor 202 and diode 212 at 214 to resistor matrix 216.

As current flows through resistor 220, transistor 240 turns on, and base 252 of transistor 250 is shorted out. Pulse signal 102*b* from the timing circuit thus is blocked from reaching the pulse transformer in circuit 101, and the fire sequence is inhibited. As a result, missile 22 is not launched from missile launcher 32. Signal 102*c* in wire cut circuit 103 is inhibited in a like manner.

As shown in FIG. 5, after each attempt to fire a missile, at the system reset time, Rho reset signal 210 momentarily goes high and is used to reset the flip-flop for the next firing.

Figure 6:
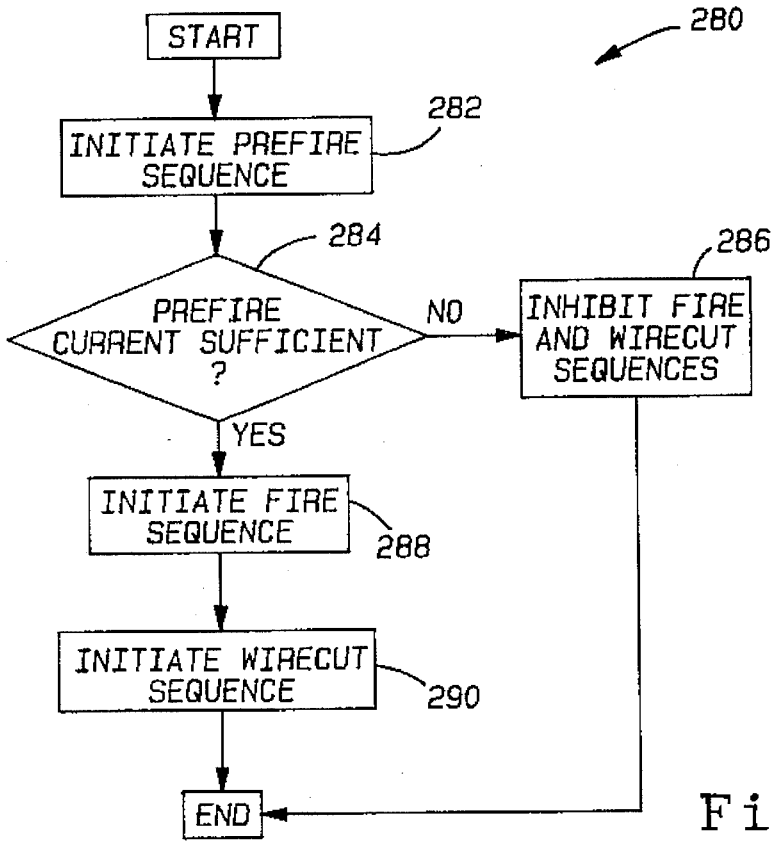
FIG. 6 is a flow diagram illustrating the operation of the missile launch safety enhancement apparatus of the present invention.

FIG. 6 is a flow diagram, shown generally at 280, illustrating the operation of the missile launch safety enhancement apparatus. At 282, the pre-fire timing circuit generates a command to initiate the prefire sequence. At 284, the safety enhancement apparatus determines if current generated in response to the signal from the prefire timing circuit is above a predetermined minimum level required to initiate the prefire sequence. If the current is not sufficient, for reasons such as faulty aircraft or missile wiring, the fire and wire cut sequences sequentially occurring after the prefire sequence are inhibited at 286, and missile 22 is not launched. If the prefire current is of a sufficient level, missile warhead 23 is enabled, and the fire and wire cut sequences are not inhibited. Missile 22 is fired subsequent to the missile fire sequence being initiated at 288, and wires that connected the fired missile 22 to missile launcher 84 are cut at 290.

As can be appreciated, the missile launch safety enhancement apparatus disclosed herein may be retrofitted into any of the M-65, M-65/LAAT, M-65/CNITE and TAMAM Nite Targeting System (NTS) aircraft-based missile guidance and tracking systems. In addition, it is contemplated that the present invention may also be implemented in ground based TOW missile launching systems such as those that are implemented on Bradley Fighting Vehicle Systems (BFVS), HUMVEE Vehicles and armored personnel carriers such as the GMHE Integrated TOW system (GITS) vehicles. The launch safety enhancement mechanism prevents firing of missiles having nonenabled warheads and is effective in preventing functional, nonenabled warheads from falling into hostile hands. The launch safety enhancement mechanism can also prevent the expenditure of an expensive piece of ordance (the missile) due to system or aircraft malfunctions during training exercises.

Various other advantages of the present invention will become apparent to those skilled in the art after having the benefit of studying the foregoing text and drawings, taken in conjunction with the following claims.

What is claimed is:

1. A missile launch safety enhancement apparatus for a missile launcher, comprising:

means for producing a prefire signal;

means for comparing said prefire signal to a reference signal level; and means for interrupting a missile firing sequence if said prefire signal is not below said reference signal level by a predetermined amount.

2. The apparatus of claim 1, wherein said prefire signal is a differential voltage indicative of a prefire current.

3. The apparatus of claim 2, further comprising;

a first voltage divider set at a predetermined voltage;

a second voltage divider for measuring said prefire current; and a comparator that turns on if a voltage differential between said first and second voltage dividers is greater than a predetermined voltage differential.

4. The apparatus of claim 2, further comprising a plurality of thermal battery squibs, said squibs being ignited by said prefire current and initiating a prefire sequence enabling missile electronics and a missile warhead.

5. The apparatus of claim 3, wherein said interrupting means comprises:

a resistor matrix; and a transistor connected to said resistor matrix for blocking signals to said missile firing sequence if said voltage differential between said first and second voltage dividers is not below said predetermined voltage differential by a predetermined amount.

6. The apparatus of claim 5, further comprising:

a first transistor having a first transistor base, a first transistor collector and a first transistor emitter, said base of said first transistor being connected to said output of said comparing means;

an optical coupler having an input and an output, said input of said optical coupler being connected to said collector of said first transistor, said optical coupler operative for isolating said interrupting means from said launcher;

clocking means having an input and an output, said input of said clocking means connected to said output of said optical coupler and responsive to said output of said comparing means; and a second transistor having a second transistor base, a second transistor collector and a second transistor emitter, said second transistor base connected to said output of said clocking means, said second transistor causing current to flow to said resistor matrix when said clocking means clocks low.

7. A missile launch system, comprising:

a missile launcher for launching a missile, said missile launcher operable to launch said missile in a launch sequence;

a missile command amplifier for generating missile preparation commands, said preparation commands including prefire and fire commands for initiating prefire and fire sequences through said missile launcher to said missile;

control means for initializing said missile preparation commands at said missile command amplifier;

means for producing a prefire signal;

means for comparing said prefire signal to a reference signal level; and means for interrupting said launch sequence if said prefire signal is not below said reference signal level by a predetermined amount.

8. The apparatus of claim 7, wherein said prefire signal is a differential voltage indicative of a prefire current.

9. The apparatus of claim 8, further comprising:

a first voltage divider set at a predetermined voltage;

a second voltage divider for measuring said prefire current; and a comparator that turns on if a voltage differential between said first and second voltage dividers is greater than a predetermined voltage differential.

10. The apparatus of claim 8, further comprising a plurality of thermal battery squibs, said squibs being ignited by said prefire current and initiating a prefire sequence enabling missile electronics and a missile warhead.

11. The apparatus of claim 7, wherein said interrupting means comprises:

a resistor matrix; and a transistor connected to said resistor matrix for blocking signals to said missile firing sequences if said prefire current is not below said reference signal level by a predetermined amount.

12. The apparatus of claim 11, further comprising:

a first transistor having a first transistor base, a first transistor collector and a first transistor emitter, said first transistor base of said first transistor being connected to said output of said comparing means;

an optical coupler having an input and an output, said input of said optical coupler being connected to said collector of said first transistor, said optical coupler operative for isolating said interrupting means from said launcher;

clocking means having an input and an output, said input of said clocking means connected to said output of said optical coupler and responsive to said output of said comparing means; and a second transistor having a second transistor base, a second transistor collector and a second transistor emitter, said second transistor base connected to said output of said clocking means, said second transistor causing current to flow to said resistor matrix when said clocking means clocks high.

13. A method for interrupting a launch sequence of a missile in a missile system, said missile system including a missile command amplifier for generating signals initiating missile prefire, fire and wire cut sequences, said method comprising the steps of:

sensing a prefire signal as said prefire sequence is initiated;

comparing said prefire signal to a reference signal level;

sensing if said prefire signal is above said reference signal level by a predetermined amount;

initiating said fire and wire cut sequences if said prefire signal is above said reference signal by a predetermined amount; and inhibiting said fire and wire cut sequences if said prefire signal is not below said reference signal level by a predetermined amount.

14. The method of claim 13, wherein said step of sensing a prefire signal comprises sensing a differential voltage indicative of a level of current flowing in said missile command amplifier to initiate said prefire sequence.

15. In a missile command amplifier of a guided missile system, a missile launch safety enhancement apparatus, comprising:

a first voltage divider set to a predetermined voltage and having an input and an output;

a second voltage divider having an input and an output, said voltage divider for measuring current to a prefire battery squib in said missile;

a comparator for comparing a voltage differential between said first and second voltage dividers and having an input and an output, said input of said comparator connected to said outputs of said first and second voltage dividers;

a first transistor having a base, a collector and an emitter, said base of said first transistor being connected to said output of said comparator;

clocking means having an input, a clock and an output, said input connected to a prefire timing circuit, said clock in communication with said output of said first transistor, said clock going high when said first transistor turns on;

a second transistor having a base, a collector and an emitter, said base connected to said output of said clocking means; and a resistor matrix having an input and an output, said input of said matrix connected to said emitter of said second transistor, said output of said matrix for interrupting said missile firing sequence if said prefire battery squib current is not below a predetermined amount.

16. The apparatus of claim 15, further comprising a second comparator having an input and an output, said input of said second comparator connected to said output of said voltage divider, said predetermined voltage of said divider being within a dynamic range associated with said comparator.

* * * * *